US010458096B2

(12) United States Patent
Martinez et al.

(10) Patent No.: US 10,458,096 B2
(45) Date of Patent: Oct. 29, 2019

(54) SYSTEM AND METHOD FOR ALIGNING A FRONT LOADER IMPLEMENT

(71) Applicant: Deere & Company, Moline, IL (US)

(72) Inventors: Ignacio Alonso Martinez, Saltillo (MX); Claire Rogge, Mehlingen (DE)

(73) Assignee: DEERE & COMPANY, Moline, IL (US)

( * ) Notice: Subject to any disclaimer, the term of this patent is extended or adjusted under 35 U.S.C. 154(b) by 1141 days.

(21) Appl. No.: 14/798,520

(22) Filed: Jul. 14, 2015

(65) Prior Publication Data

US 2016/0076219 A1 Mar. 17, 2016

(30) Foreign Application Priority Data

Sep. 11, 2014 (DE) ..... 10 2014 218 197

(51) Int. Cl.

| | |
|---|---|
| ***E02F 3/96*** | (2006.01) |
| ***E02F 3/36*** | (2006.01) |
| ***E02F 9/26*** | (2006.01) |
| *E02F 3/627* | (2006.01) |

(52) U.S. Cl.

CPC ..... *E02F 3/96* (2013.01); *E02F 3/3604* (2013.01); *E02F 3/3631* (2013.01); *E02F 9/26* (2013.01); *E02F 3/627* (2013.01)

(58) Field of Classification Search

CPC ..... B60D 1/36; B60D 1/363; E02F 3/3604; E02F 3/3627; E02F 3/3631; E02F 3/96; E02F 9/26; Y10S 37/906

USPC ..... 33/264, 288; 37/417; 414/685

See application file for complete search history.

(56) References Cited

U.S. PATENT DOCUMENTS

| | | | | |
|---|---|---|---|---|
| 3,015,162 A | | 1/1962 | Bonnet | |
| 4,984,957 A | * | 1/1991 | Noguchi | E02F 3/3631 172/273 |
| 2005/0193603 A1 | | 9/2005 | Schultz | |

FOREIGN PATENT DOCUMENTS

| | | |
|---|---|---|
| DE | 1249305 B | 9/1967 |
| DE | 2623098 A1 | 12/1977 |
| DE | 3924313 A1 | 2/1990 |
| EP | 1586709 A2 | 10/2005 |

OTHER PUBLICATIONS

European Search Report in foreign counterpart application No. 15181974.5 dated Mar. 10, 2016 (8 pages).

* cited by examiner

*Primary Examiner* — Lynn E Schwenning
*Assistant Examiner* — Brendan P Tighe
(74) *Attorney, Agent, or Firm* — Michael Best & Friedrich LLP

(57) ABSTRACT

Front loaders typically have interchangeable implements that require an operator to drive toward a desired implement and to attempt to align the implement attachment points with the attachment points on an implement mount that is attached to the loader. This is made more difficult because the operator's view of the various attachment points (catch hook and support pins, rods, links) of the implement and the implement mount is often blocked by the front loader arms (booms) or other front loader components, thus, aligning the implement and the implement can be very difficult. The present disclosure provides for a system and method to simplify the above-described implement alignment processes.

14 Claims, 3 Drawing Sheets

SYSTEM AND METHOD FOR ALIGNING A FRONT LOADER IMPLEMENT

Pursuant to 35 USC § 119, this application claims the benefit of and priority to German patent Application No. 102014218197.6, filed Sep. 11, 2014, said German Application in its entirety being hereby incorporated by reference into the present specification.

FIELD OF THE DISCLOSURE

The invention relates to a system and a method for alignment of a front loader implement.

BACKGROUND

Front loaders are known and are generally hitched to or detachably attached to a carrier vehicle, such as an agricultural tractor. Typically, front loaders have front loader arms (or booms) extending from and out in front of the carrier vehicle to an implement mount that allows for detachably connecting to an interchangeable implement, such as a loading shovel, a feed shovel, a loading fork, a bale gripper, or a spike. The implement is generally attached by catch hooks to support pins, rods or links that are formed on the implement mount. Alternatively, the catch hook may be on the implement mount and the support pin, rod or link on the implement.

In these processes, the implement and the implement mount must be brought into a predetermined position relative to one another in order to guarantee correct alignment and attachment. This is generally achieved in that an operator aims at the implement while driving towards it, attempting in particular to bring the catch hooks and the support pins, rod or links into alignment. This is made more difficult because the operator's view of the attachment points or essential components (catch hook and support pins, rods, links) of the implement and the implement mount is often blocked by the front loader arms (booms) or other front loader components, thus, aligning the implement and the implement can be very difficult and may have to be done "blindly". The above-mentioned processes when aligning an implement can take an extended period of time. This is annoying to the operator, unsatisfactory and not cost-effective, especially when implements are frequently exchanged.

Simplifying the above-described processes and in particular making them more user-friendly is therefore an important concern for an operator.

SUMMARY

In these processes, the implement and the implement mount must be brought into a predetermined position relative to one another in order to guarantee correct alignment and attachment. This is generally achieved in that an operator aims at the implement while driving towards it, attempting in particular to bring the catch hooks and the support pins, rods or links into alignment. This is made more difficult because the operator's view of the attachment points or essential components (catch hook and support pins, rods, links) of the implement and the implement mount is often blocked by the front loader arms (booms) or other front loader components, thus, aligning the implement and the implement can be very difficult and may have to be done "blindly".

According to an aspect of the present disclosure, a system and a method for alignment of an implement using marks that are visually recognizable from the cab of the carrier vehicle is disclosed. These marks on the implement and on the implement mount are in the region of the front loader operator's field of view during the alignment process and can be aligned with one another in the vertical direction and/or the horizontal direction.

Because the marks lie within the front loader operator's field of view during the alignment process of the implement, an operator can travel in a targeted manner to the required position, in which the catch hooks and the support pins are aligned correctly with one another. Thereby coupling maneuvering is minimized and the time expended for exchanging the implement is optimized and therefore the attachment process is made more cost-effective. For example, the implement can be provided with a mark in the form of a horizontal and vertically oriented cross or crosshairs, and the implement mount can be provided with a point-like mark. The marks are arranged offset toward the center of the implement in relation to the catch hooks and/or in relation to the carrier pins in such a way that they fall or lie within the visual field. When maneuvering and approaching with the front loader in order to attach an implement, the cross and the point-like marks are aligned with one another such that the point-like mark is preferably guided into the center of the cross. The operator then knows that the correct height and also the correct lateral position has been reached and that the catch hooks and support pins are aligned correctly in relation to one another, even if they are not within the visual field where they could be viewed by the operator. The operator can conclude the attachment process by simply lifting and tilting the implement carrier so that the locking devices engage with one another. The shapes of the marks on the front loader implement can be formed in a variety of ways; thus an arrow-shaped mark, linear marks aligned with one another, a circle, an "X" or the like can also be provided in place of a cross. The use of a circle is also advisable because the operator then need only guide the mark formed on the implement mount into the interior of the circle from his visual perspective.

The marks can also be formed in a variety of manners such as by distinctive colors or distinctive surface structures. It is additionally conceivable to use distinctive components formed on the front loader implement or on the implement carrier, such as a distinctive sheet-metal strip, a spike, a notch-and-bead sight, a pointer or the like.

It can also be advantageous to design the marks to be light-reflective, so that a faultless coupling is guaranteed even in poor weather, in the dark or at dusk, by illuminating the front area of the loader with lighting on the carrier vehicle.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
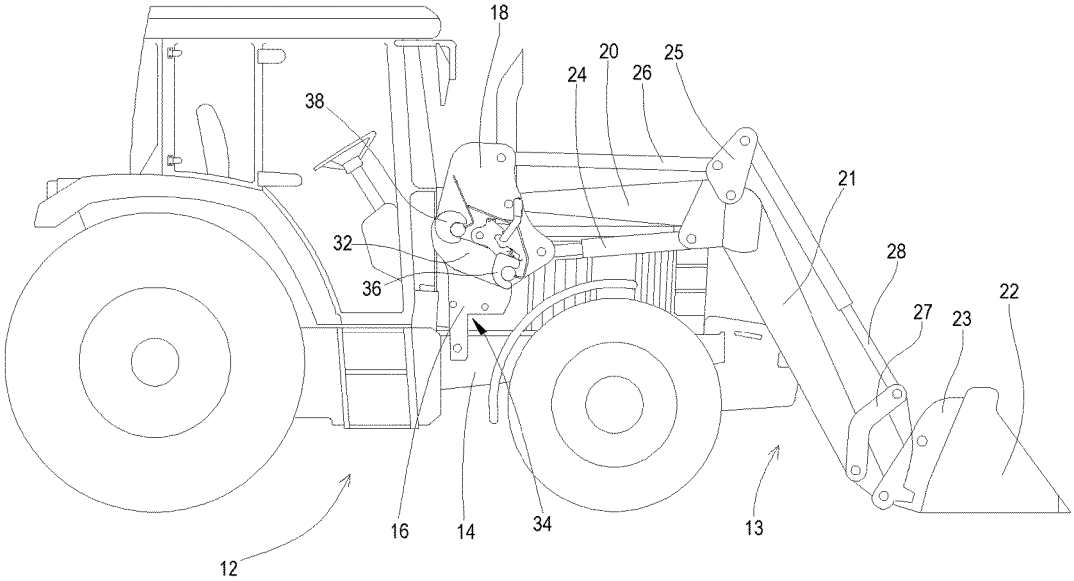
FIG. 1 is a schematic side view of a front loader arrangement having a front loader implement and an implement carrier.

Referring now to the drawings, and in particular FIG. 1, there is a front loader detachably coupled to a carrier vehicle 12 in accordance with an embodiment of the present disclosure. Carrier vehicle 12 may be an agricultural tractor. The front loader has two front loader arms (or booms) 20 extending from both sides of the carrier vehicle 12 to an implement mount 23 that allows for detachably connecting to an interchangeable implement 22. While the implement 22 shown in FIG. 1 is a loading shovel, one of ordinary skill in the art will realize that this implement 22 can be many different things including without limitation a feed shovel, a loading fork, a bale gripper, or a spike.

The front loader arms (or booms) 20 are coupled to a mounting mast 18, which, in turn, are detachably connected to a mounting frame 16 in receiving region 32. Further, the mounting frame 16 is attached to the vehicle frame 14 of the carrier vehicle 12 in the fastening region 34. The front loader arms 20 can be raised and lowered by hydraulic lifting cylinders 24. Between links 25, connected to the front loader arms 20 on each side, and the respective installation mast 18, there is a control rod 26 which is used for parallel guidance of the front loader.

Further, the implement mount 23, to which the implement 22 is be attached, is arranged at the front end of the front loader arms (or booms) 20. The implement 22 can be pivoted on both sides of the front loader arm 20 via a pivot rod 27 connected to the front loader arms 20 and the implement mount 23, and via a hydraulic pivot cylinder 28 connected to the respective pivot rod 27 and the respective link 25.

Figure 2:
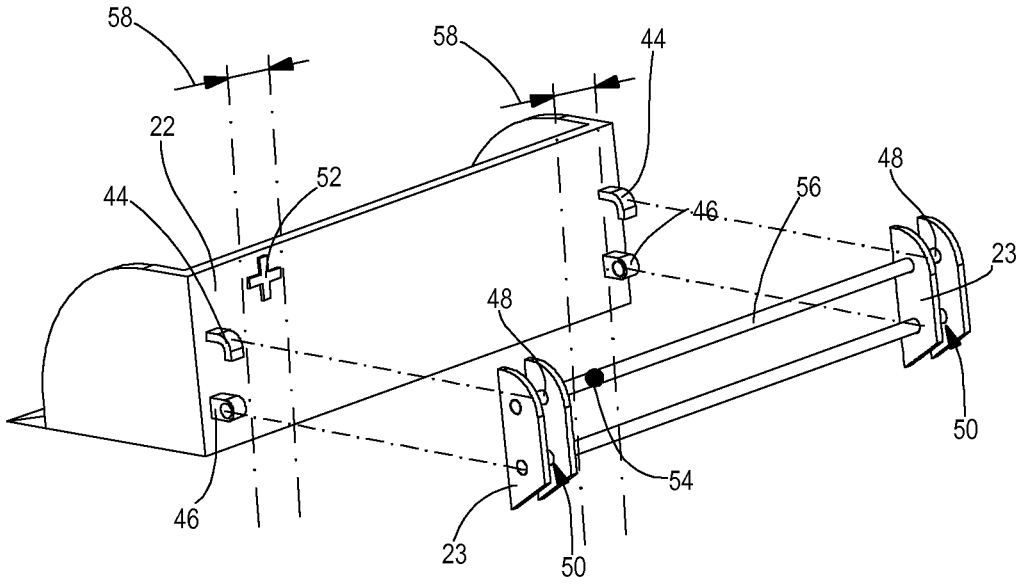
FIG. 2 is a perspective side view of the front loader implement and the front loader carrier from FIG. 1.

Now referring to FIG. 2, the rear side of the implement 22, catch hooks 44 arranged in the upper part are constructed and locking eyelets 46 are constructed in the lower part of the rear side. Support pins 48 and locking points 50 are formed on the implement mount 23. One of ordinary skill in the art will appreciate that there are numerous means for attaching the implement 22 to the implement mount 23 including without limitation having the catch hook on the implement mount and the support pin, rod or link on the implement.

Additionally, one of ordinary skill in the art will understand that the operator's view from the cab 40 of the implement 22 and the implement mount 23 may be blocked or crowded by the front loader components like the front loader arms 20, the installation mast 18, the link 25, or the engine hood 42.

As described in the present disclosure, use of marks 52, 54 that are visually recognizable from the cab 40 are utilized.

In one embodiment of the present disclosure, a mark 52 is applied to the implement 22 and a complementary mark 54 is applied to a frame part 56 of the implement mount 23. one of ordinary skill in the art will understand that these marks on the implement 22 and implement mount 23 can be formed in a variety of ways; including without limitation as a horizontal and vertically oriented cross or crosshairs, a point-like mark, an arrow-shaped mark, linear marks aligned with one another, a circle, and an "X". Further, one of ordinary skill in the art will understand that these marks can also be formed in a variety of manners such as by distinctive colors or distinctive surface structures; including without limitation distinctive sheet-metal strip, a spike, a notch-and-bead sight, or a pointer.

Figure 3:
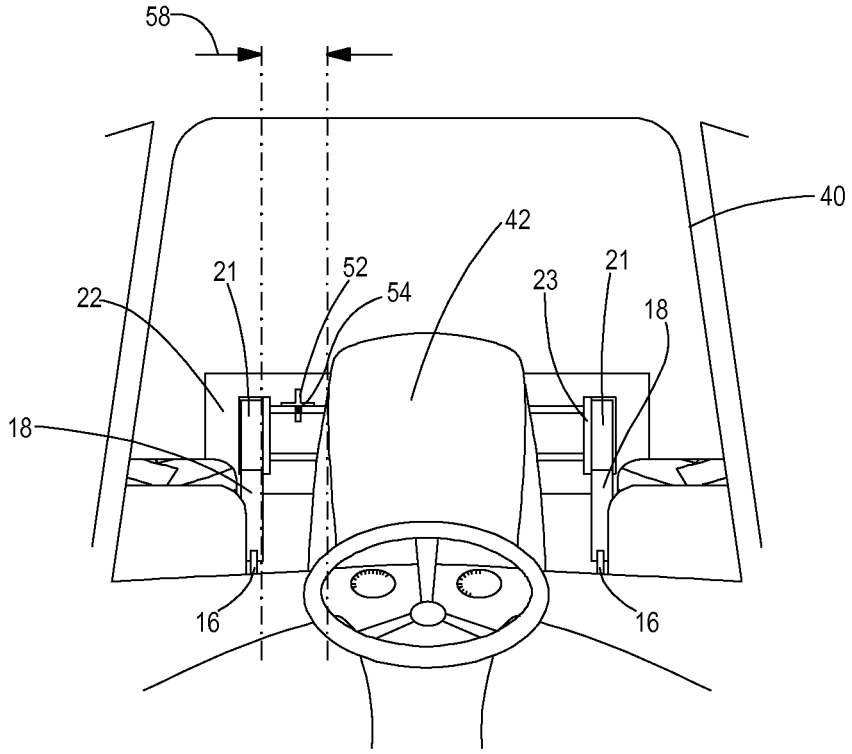
FIG. 3 is a schematic view of the front loader arrangement from the view of an operator during an attachment process.

In this embodiment of the present disclosure, with reference to FIG. 3, marks 52, 54 are situated in a region of a field of view 58, which extends on the side of the engine hood 42 and is bounded by the sides of the engine hood 42 and by the beams 21 extending forward from the mounting mast 18 to the implement carrier 23. The field of view 58 allows a free view of the implement carrier 23 and the front loader implement 22 in a region that lies between the catch hooks 44 and the support pins 48 and is not concealed by the front loader arm 20.

In this embodiment, FIG. 3 shows a view of the front loader from the perspective of an operator in the cab 40 during an attachment process of the implement 22. The engine hood 42 extends toward the front in the direction of travel of the carrier vehicle 12. The beams 21 of the front loader arms 20 are arranged on the sides of the engine hood 42 and extend parallel to the sides of the engine hood 42, likewise toward the front. The implement 22 and the implement mount 23 are located in front of the engine hood 42, wherein the catch hooks 44 and support pins 48 are concealed by the beams 21 and cannot be seen.

Alternatively, in this embodiment, mark 52 which is a horizontal and vertically oriented cross and mark 54 can be seen from the cab 40 and make easy and targeted maneuvering during the attachment process of the front loader implement 22 for the operator.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A system comprising:

a carrier vehicle including two front loader arms;

an implement mount coupled to the carrier vehicle comprising a first mark, wherein the first mark is positioned on the implement mount between the two front loader arms; and an implement detachably coupled to the implement mount comprising a second mark, wherein the first mark and the second mark are both visually recognizable from the carrier vehicle between the two front loader arms when the implement is coupled to the implement mount, wherein the second mark is positioned on the implement at a location that aligns with the first mark in a forward direction relative to the carrier vehicle when the implement is in position for coupling with the implement mount, and wherein the first mark is positioned on the implement mount at a location that is aimed at the second mark from the perspective of the carrier vehicle when the carrier vehicle is aligned with the implement in the forward direction while the carrier vehicle moves towards the implement in the forward direction.

2. The system of claim 1, wherein the implement is at least one selected from a group consisting of a feed shovel, a loading fork, a bale gripper, and a spike.

3. The system of claim 1, wherein the first mark is applied to a frame of the implement mount.

4. The system of claim 1, wherein the second mark is a horizontal and vertically oriented cross.

5. The system of claim 1, wherein the first mark is at least one selected from a group consisting of a point, an arrow, a circle, and an "X".

6. The system of claim 1, wherein the second mark is at least one selected from a group consisting of a point, an arrow, a circle, and an "X".

7. The system of claim 1, wherein the first mark comprises at least one selected from a group consisting of a distinctive color, a distinctive surface structure, and a light-reflective surface.

8. The system of claim 1, wherein the second mark comprises at least one selected from a group consisting of a distinctive color, a distinctive surface structure, and a light-reflective surface.

9. The system of claim 1, wherein the second mark is positioned directly on a back surface of the implement, wherein the first mark is positioned on a frame of the implement mount and wherein the first mark and the second mark are both visible from the carrier vehicle in a field of view that is bounded between a side of the engine hood of the carrier vehicle and one of the two front loader arms.

10. A method of operating the system of claim 1, the method comprising:

driving the carrier vehicle toward the implement; and aligning the implement mount and the implement using the first mark and the second mark.

11. The method of claim 10, further comprising the step of attaching the implement mount to the carrier vehicle.

12. The method of claim 10, wherein the second mark includes a horizontal and vertically oriented cross, and wherein the step of aligning the implement mount and the implement using the first mark and the second mark comprises aiming the first mark at the center of the horizontal and vertically oriented cross while driving the carrier vehicle toward the implement.

13. The method of claim 10, further comprising the step of attaching the implement to the implement mount.

14. The method of claim 10, wherein the second mark is a circle, and wherein the step of aligning the implement mount and the implement using the first mark and the second mark comprises aiming the first mark at the center of the circle while driving the carrier vehicle toward the implement.

* * * * *